US006104907A

United States Patent [19]

Obata et al.

[11] Patent Number: 6,104,907

[45] Date of Patent: Aug. 15, 2000

[54] IMAGE RECORDING APPARATUS WHICH PREVENTS VARIATION IN SPEED OF A RECORDING MEDIUM AND REDUCES SHIFT VALUES THEREOF

[75] Inventors: Shigeru Obata, Ishioka; Hidefumi Ohtsuka, Ibaraki-ken; Shuho Yokokawa, Mito; Isao Nakajima; Akitomo Kuwabara, both of Hitachinaka, all of Japan

[73] Assignees: Hitachi, Ltd.; Hitachi Koki Co., Ltd., both of Tokyo, Japan

[21] Appl. No.: 09/066,751

[22] Filed: Apr. 27, 1998

[30] Foreign Application Priority Data

Apr. 28, 1997 [JP] Japan ..... 9-110620
Sep. 8, 1997 [JP] Japan ..... 9-242486

[51] Int. Cl.[7] ..... G03G 15/00

[52] U.S. Cl. ..... 399/384; 226/21; 226/60; 226/118.3; 226/187; 399/395; 399/396

[58] Field of Search ..... 399/298, 299, 399/306, 316, 317, 384, 395, 396; 226/21–23, 60, 76, 118.3, 187; 242/615.21

[56] References Cited

U.S. PATENT DOCUMENTS 5,765,081 6/1998 Bogaert et al. ..... 399/299

FOREIGN PATENT DOCUMENTS 60-171962 9/1985 Japan .
4-166367 6/1992 Japan .
4-251060 9/1992 Japan .
8-26542 1/1996 Japan .

*Primary Examiner*—William J. Royer
*Attorney, Agent, or Firm*—Anotnelli, Terry, Stout & Kraus, LLP

[57] ABSTRACT

There is provided an image recording apparatus which does not cause a print shift or a color drift caused by vibration and a widthwise shift due to speed variation in a conveying direction of a continuous sheet such as rolled paper or folded paper, in which a variation in speed is prevented by rollers which wind and clamp the sheet on and between an upper and a lower roller which are driven by the conveying force of the sheet, so as to prevent occurrence of vibration in the conveying direction, and a guide roller having pins adapted to be engaged in sprocket holes of the sheet are provided between the set-up positions of the tractors.

26 Claims, 12 Drawing Sheets

$\mu$: DYNAMIC FRICTIONAL COEFFICIENT $\alpha$: WINDING ANGLE r : ROLLER RADIUS

TRANSMISSION TORQUE $T = r\,Te(e^{\mu\alpha}-1)/e^{\mu\alpha}$

EFFECTIVE TENSION $Te = T_1 - T_2$

IMAGE RECORDING APPARATUS WHICH PREVENTS VARIATION IN SPEED OF A RECORDING MEDIUM AND REDUCES SHIFT VALUES THEREOF

BACKGROUND OF THE INVENTION

The present invention relates to an image recording apparatus, and in particular, to an image recording apparatus which is favorable for continuously conveying a continuous recording medium such as paper or a sheet-like plastic film.

Image recording apparatuses have been used for stably conveying continuous paper into an image recording part. For example, Japanese Patent Unexamined Publication No. 8-26542 discloses an image recording apparatus incorporating a tractor for conveying a sheet to the upstream side of a photosensitive drum for forming a toner image, in which the rollers for conveying the sheet at a speed equal to that of the tractor are provided between the photosensitive drum and the tractor so as to prevent the sheet from slipping off or jamming in the tractor part.

Further, Japanese Patent Unexamined Publication No. 4-251060 discloses a system incorporating a pair of paper feed rollers provided between a recording part and a roll-like sheet, for slacking the sheet upstream of the recording part so as to prevent variation of conveying load in the recording part while the sheet is conveyed.

Japanese Patent Unexamined Publication No. 4-166367 discloses a system in which a sheet from a paper roll is applied thereto with a back tension by means of a pair of rollers provided between a recording part and a sheet so as to wind the sheet onto a roller for removing curling therefrom in order to stably convey the sheet.

Further, Japanese Patent Unexamined Publication No. 60-171962 discloses a system in which a roller displaces in response to a variation in the tension of a sheet so as to uniformly maintain the tension of sheet in order to prevent occurrence of print shift in multi-color printing.

The conveyance of a recording medium (which will be herein below referred as "sheet") such as a continuous sheet, causes variation (vibration) in the speed in the direction of conveyance of the sheet due to the feeding action of a sheet supply part or the like.

Further, the supply of a continuous sheet by tractors possibly causes a crosswise shift in the vicinity of the center part thereof between tractors due to some play between tractor pins and feed holes.

In the case of a conventional monosurface monochromatic image recording apparatus, the distance between the tractors has been small so that the degree of the shift is low, and therefore no serious problems have been raised.

Accordingly, in the case of high quality printing, in particular, in the case of printing a color image or of double surface printing, a print shift in an imager transfer part and a shift or speed variation in the case of printing with more than two colors, cause the occurrence of a transferred color drift, that is, the speed variation and the shift reduce the printing quality.

Accordingly, color matching and alignment between the front and rear surfaces of a sheet have to be made, and in order to precisely position a sheet in each of a plurality of image recording parts, it is necessary to restrain such a sheet speed variation or keep such a shift to a minimum.

However, the above-mentioned Japanese Patent Unexamined Publication No. 8-26542 and Japanese Patent Unexamined Publication No. 4-251060 do not address the problems caused by the above-mentioned variation in the image recording apparatus.

Further, the image recording apparatus disclosed in Japanese Patent Unexamined Publication No. 4-166367 results in such a problem that a sheet shifts widthwise or meanders since a pair of rolls for applying a back-tension to the sheet in order to remedy curling of the sheet, press only opposite ends of the sheet so that the pressing force is not uniform widthwise direction thereof.

Japanese Patent Unexamined Publication No. 60-17926 discloses the image recording apparatus which is used in a printing device such as an offset press including a large-scale mechanism for preventing occurrence of a print shift.

SUMMARY OF THE INVENTION

An object of the present invention is to provide an image recording apparatus incorporating a means for preventing speed variation in the sheet conveying direction and a means for reducing shift during conveyance of the sheet, thereby preventing an image from being misconfigured.

DESCRIPTION OF THE PREFERRED EMBODIMENTS

Explanation will be made of an embodiment of the present invention with reference to the drawings.

Figure 1:
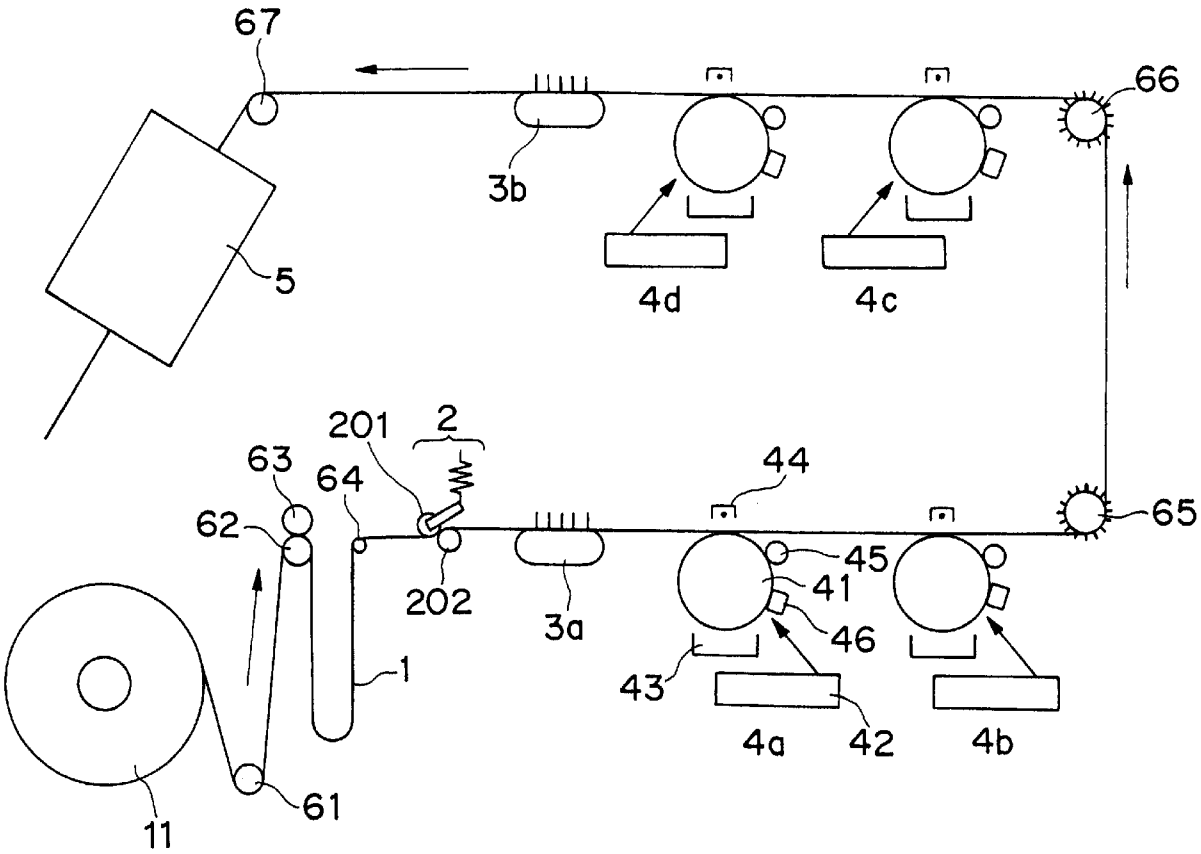
FIG. 1 is a view illustrating an image recording apparatus in an embodiment of the present invention.

Referring to FIG. 1 which shows a laser printer as an image recording apparatus according to the present invention, explanation will be hereinbelow made of the overall arrangement of the laser printer.

A continuous sheet or a sheet-like plastic film 1 having sprocket holes, (which will be hereinbelow denoted "sheet")

is paid out from a roll 11 as a sheet pay-out part which is attached so as to be rotated and stopped by a motor which is not shown. The sheet paid-out from the roll 11 is delivered by a drive roller 62 and a driven roller 63 which serve as a sheet conveying means for conveying a sheet through the intermediary of an auxiliary roller 61, being controlled so as to maintain a constant buffer value.

The delivered sheet 1 is conveyed to a speed variation preventing means 2 in which the sheet 1 is wound on rollers 201, 202 through the intermediary of an auxiliary roller 64 so as to remove vibration in the sheet conveying direction. Further, it is then fed to tractors 3*a* for synchronously rotating pinned belts.

Thereafter, the sheet 1 is conveyed to image recording parts 4*a*, 4*b* for transferring toner images thereon from photosensitive drums 41 each of which is coated over its metal drum surface with a photosensitive layer and is rotatable. Each photosensitive drum 41 is uniformly charged over its surface by a charger 46, and is formed on its surface with an electrostatic latent image by means of an optical system 42. Thereafter, the electro-static latent image is turned into a toner image by a developing unit 43 for developing a latent image with the use of toner so as to form a toner image. The toner image formed on the photosensitive drum 41 is transcribed onto the sheet 1 by a transcribing corotron 44. Toner remaining on the photosensitive drum 41 after the transcription is removed by a drum cleaner 45.

Thereafter, the conveying direction of the sheet 1 is fed by guide rollers 65, 66, and then a two-color transcribed image is similarly formed on the second surface of the sheet by image recording parts 4*c* and 4*b*. Thus, a two-color image is formed on both surfaces of sheet 1, and thereafter, conveyed by roller 67 to a fixing part 5 for fixing the images onto the sheet 1, after passing through tractors 3*b*. After the fixing of the sheet 1, the sheet 1 is conveyed to an after-treatment part. In the case of four-color printing, a two-color imaging part is incorporated downstream of the image recording parts 4*b*, 4*d*.

Next, explanation will be made of a speed variation preventing means with reference to FIG. 2.

The speed variation preventing means 2 has a pair of upper and lower rollers which partly wind the sheet thereon and clamp the same therebetween in order to prevent occurrence of vibration in the sheet conveyance direction. The speed variation preventing means 2 has to be provided on the roll 11 side of the image recording parts, that is, upstream of the image recording parts in order to prevent occurrence of speed variation caused by vibration of the sheet, before the sheet 1 has been conveyed to the image recording parts 4*a* to 4*d*.

Roller parts 201*a* to 201*e* which are spaced from one another, widthwise of the sheet, are arranged on the upper side of the speed variation preventing means 2, and a roller 202 extending over the overall width of the sheet 1 is arranged on the lower side of the speed variation preventing means 2. Each of the upper roller parts 201*a* to 201*e* on the upper side, includes a roller 201 for clamping the sheet 1, which is rotatably attached to left and right arms 203, 204 which are attached to a shaft 207 so as to be rotatable about their fulcrum positions.

The roller 202 on the lower side is straight or crowned over the entire width of the sheet. The rollers 201 and 202 are rotated by being driven by the conveying force of the sheet 1. Further, a spring 205 for applying a sheet clamping force is attached to a shaft 206 extending between the left and right arms 203, 204.

It is noted that, in the alternative, a plurality of rollers spaced from one another may be provided on the lower side of the speed variation preventing means 2, and a roller extending over the entire width of the sheet may be provided on the upper side thereof.

Explanation will hereinbelow be made of technical effects and advantages of such an arrangement that the sheet is wound to prevert vibration.

Figure 3:
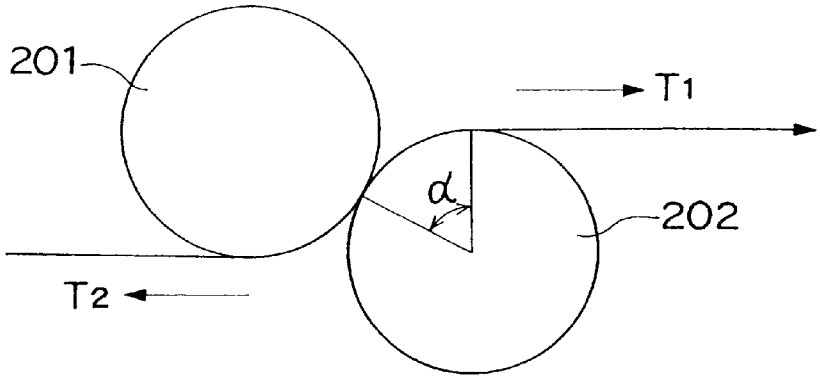
FIG. 3 is a typical view illustrating a sheet winding part.

FIG. 3 is a typical view which shows a sheet winding part. A transmission torque T is given by the Euler's theory and is exhibited by the following formula (1):

$$T=rT_e(e^{\mu\alpha}-1)/e^{\mu\alpha} \quad (1)$$

where $\mu$ is a dynamic friction coefficient between the roller and the sheet, $\alpha$ is an effective winding angle, r is a roller diameter, and Te is an effective tension exhibited by $T_1-T_2$ in which $T_1$ is a tension on the conveying side, and $T_2$ is a tension on the sheet supply side.

Figure 4:
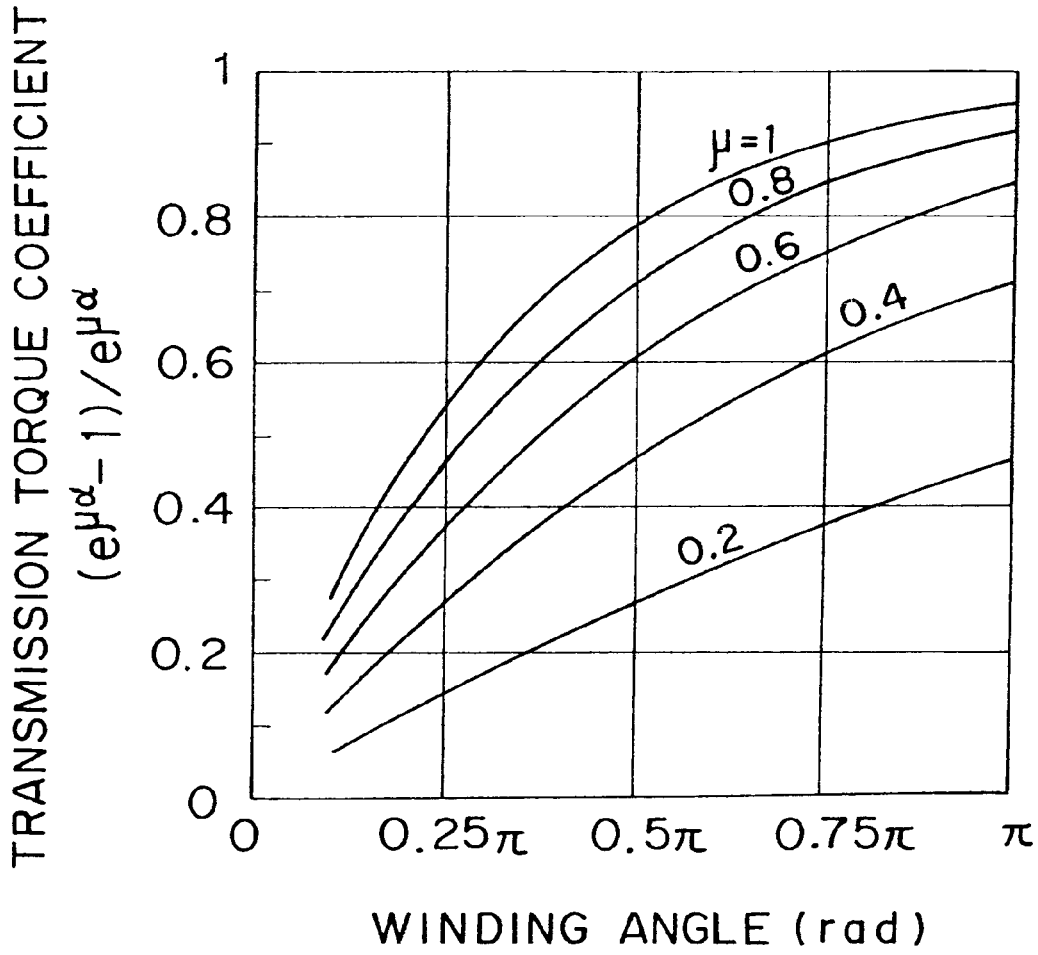
FIG. 4 is a graph showing a relationship among a dynamic frictional coefficient $\mu$ between a roller and a sheet, a sheet winding angle and a coefficient of transmission torque applied to a roller.

FIG. 4 is a graph which shows the relationship between the winding angle and the coefficient of the transmission torque in formula (1) as the dynamic frictional coefficient $\mu$ is changed. From this graph, it can be understood that the torque transmitted to the roller increases as the dynamic frictional coefficient or the winding angle becomes larger.

As to a vibration damping roller having a structure shown in FIG. 1, it is considered that the frictional force by the pressing force of the pressing side roller 201 is $T_2$. Further, the speed variation as discussed here can be considered as variation in the tension $T_2$ and accordingly, it is considered that the speed variation can be reduced by the pressing force of the roller and by consumption of the energy of the sheet through the transmission of the torque. Meanwhile, in view of the overall sheet conveyance, it is considered that both the pressing roller and the sheet winding cause the load to increase, and accordingly, if it becomes excessively large, sprocket holes in the sheet are possibly damaged or deformed. That is, the so-called hole missing possibly occurs. As to a sheet having a ream weight of 55 Kg, which is generally used, a total pressing force from 100N to 5 kN, and a winding angle of 0° to 180°, preferably, 100 to 2 kN and 10° to 50°, exhibit a satisfactory effect of reducing speed variation without greatly changing the sheet conveying direction.

The sheet 1 paid out from the roll 11 is fed in a direction indicated by the arrow while images are recorded on the sheet 1. The paid-out sheet 1 vibrates due to variation in the tension of the sheet, which is caused by a buffer value during conveyance of the sheet 1 into the image recording parts, and by flattering of the sheet 1 in the buffer part. In particular, in the case of the high speed conveyance (for example, 1 m/s) this vibration increases. The sheet 1 vibrating is wound on the rollers 201, 202 which make contact with each other at a predetermined angle from the vertical direction, and in this condition, the sheet 1 is clamped by the forces of the springs 205. The energy of vibration of the sheet 1 is consumed through the clamping between the rollers 201, 202, and through the transmission of the torque, which is caused by winding the sheet 1 onto the rollers, and accordingly, it is possible to prevent occurrence of speed variation of the sheet 1.

Further, the roller parts 201*a*, 201*b*, 201*c*, 201*d*, 201*e* can press the sheet 1, independent from one another, and are spaced from one another, corresponding to the width of the sheet 1. Thus, the distribution of pressure width wise of the sheet 1 becomes uniform so as to prevent the sheet 1 from skewing, and the rate of the accommodation space thereof with respect to the overall apparatus can be reduced.

Figure 2:
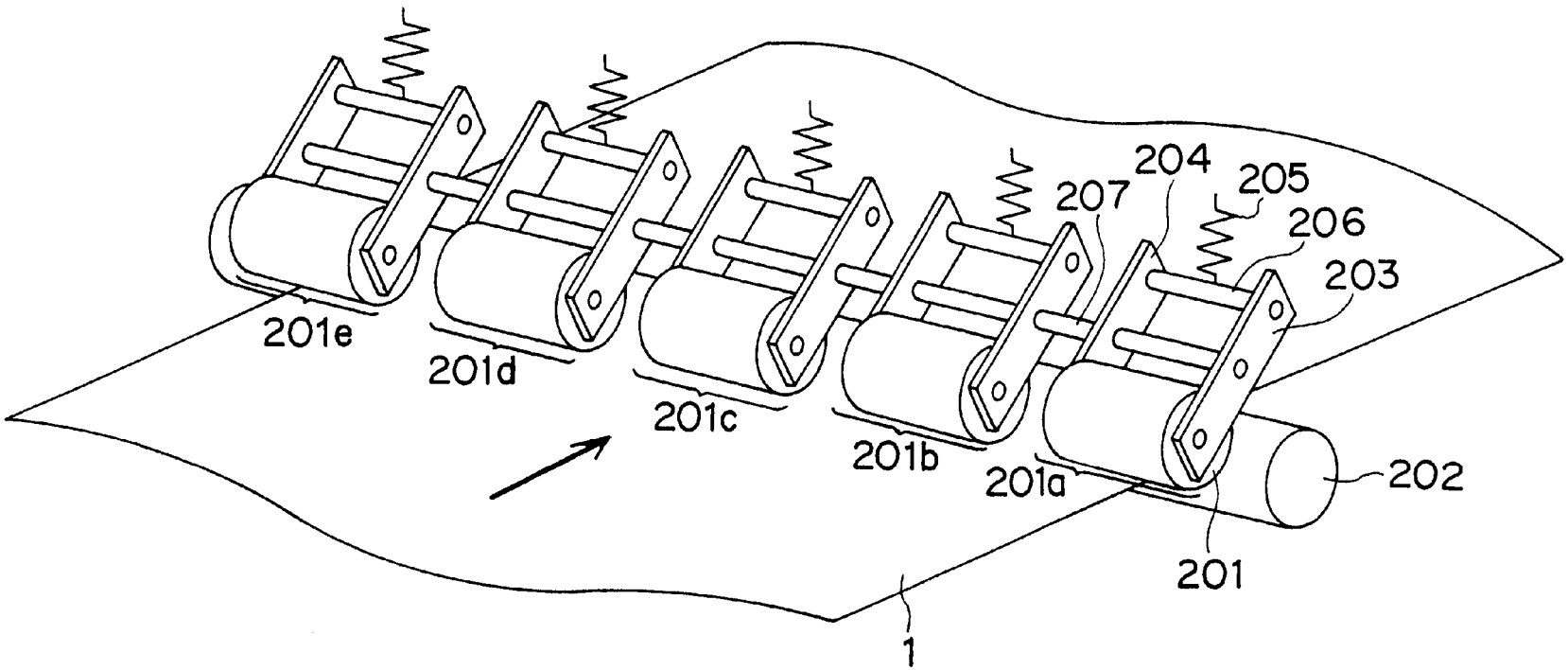
FIG. 2 is a detailed perspective view illustrating a means for preventing speed variation.
Figure 5A:
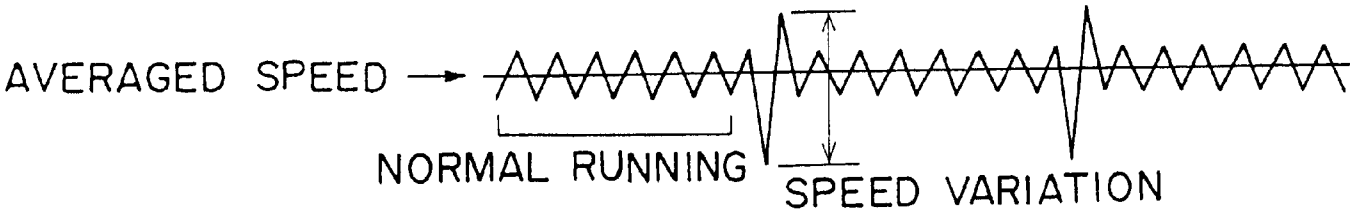
FIGS. 5*a* and 5*b* are views showing results of detection of speed variation when a sheet is conveyed without using a speed variation preventing means or a sheet is conveyed with using the speed variation preventing means.
Figure 5B:
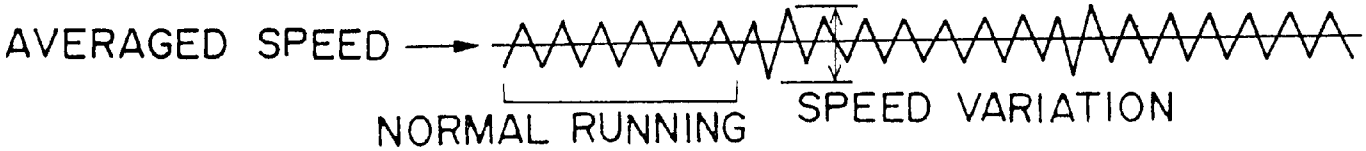

FIG. 5*a* shows a result of detection of speed variation when the sheet 1 is conveyed without using the speed variation preventing means shown in FIG. 2, and FIG. 5*b* shows a result of detection of speed variation when the sheet 1 is conveyed with the use of the speed variation preventing means shown in FIG. 2. As understood from FIG. 5*a*, large speed variation occurs since there is provided no means for preventing vibration of the sheet 1. However, as understood from FIG. 5*b*, the speed variation is small since the sheet 1 is conveyed with the use of the speed variation preventing means, and less difference is appreciated in comparison with a normal conveying condition. Accordingly, it is possible to obtain a satisfactory image without a print shift and a color drift.

Next, referring to FIGS. 6 to 8*b*, explanation will be made of guide rollers 65 and 66 which prevent occurrence of a shift during conveyance of the sheet 1. As clearly understood from FIG. 8*a* and 8*b*, each guide roller 65 and 66 includes a roller 23, an endless belt 22 on which pins 21 are provided at intervals equal to that of the sprocket holes of the sheet 1, and which is rotatably set around the outer periphery of the roller 23, and side plates 24, 25 for preventing the belt 22 from coming off from the roller 23. The rollers 23 can be fixed at an optional position, depending upon a width of the sheet 1, on a shaft 26 attached to side plates which are not shown, in the image recording apparatus.

Figure 6:
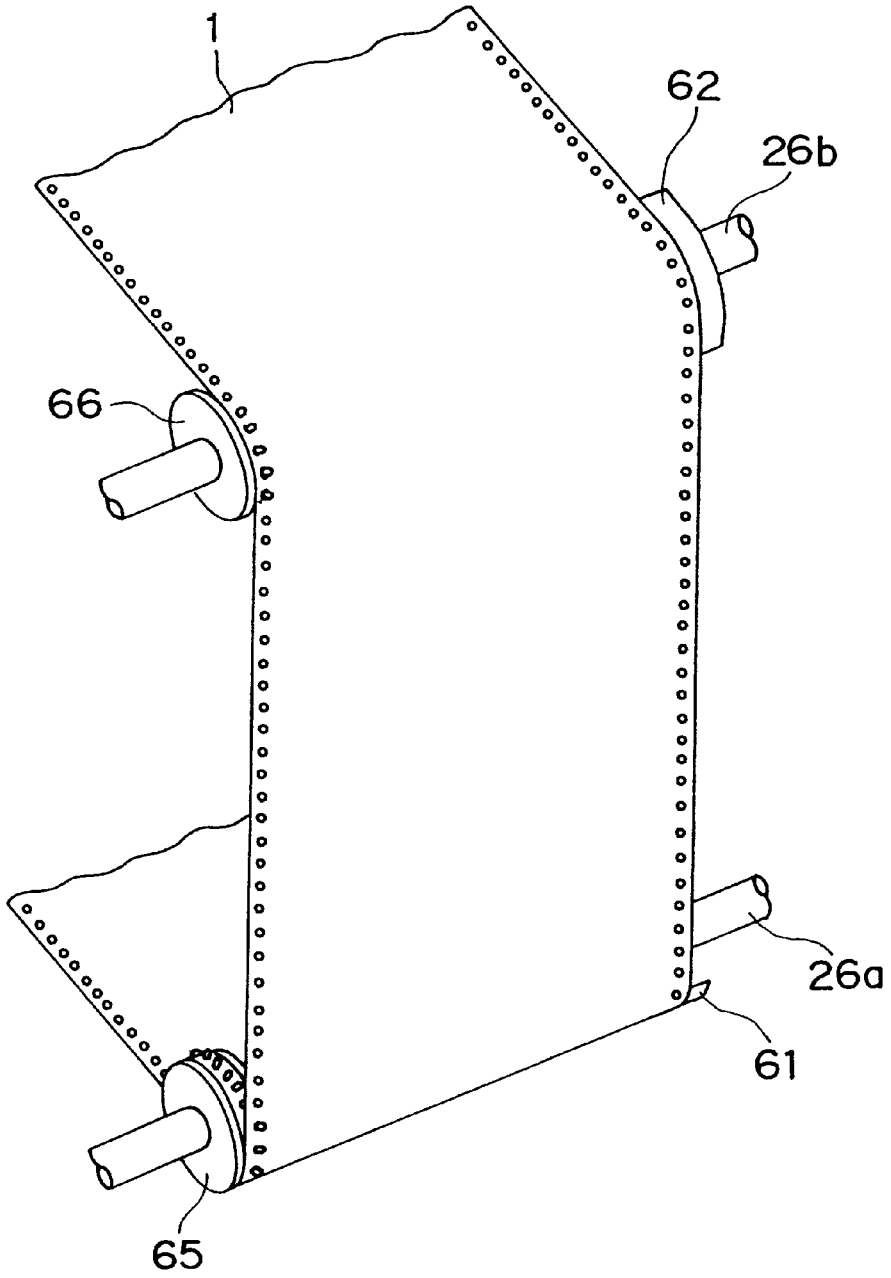
FIG. 6 is a perspective view illustrating an example of a shift reducing means.
Figure 7A:
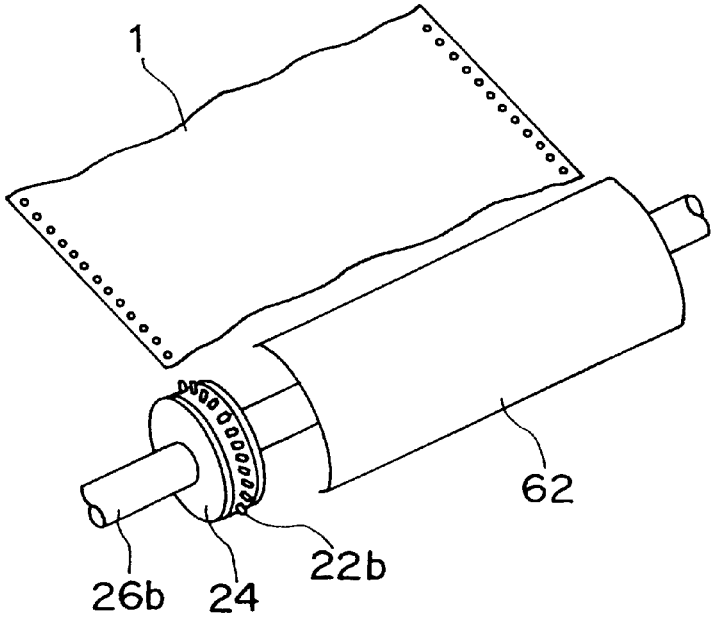
FIGS. 7*a* and 7*b* are perspective views illustrating the shift reducing means from which a part of a sheet is removed.
Figure 7B:
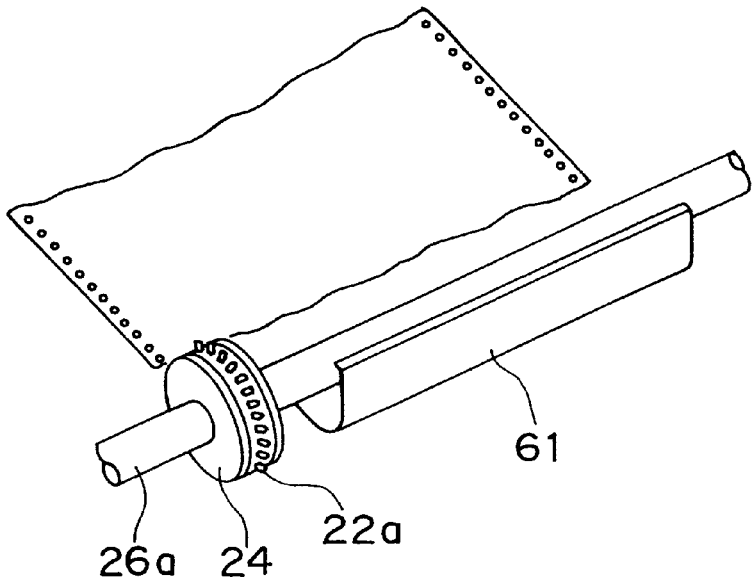
Figure 8A:
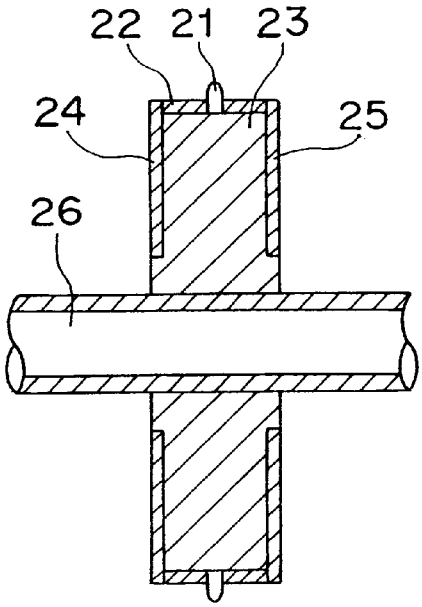
FIGS. 8*a* and 8*b* are sectional views illustrating an example of a structure of a guide roller.
Figure 8B:
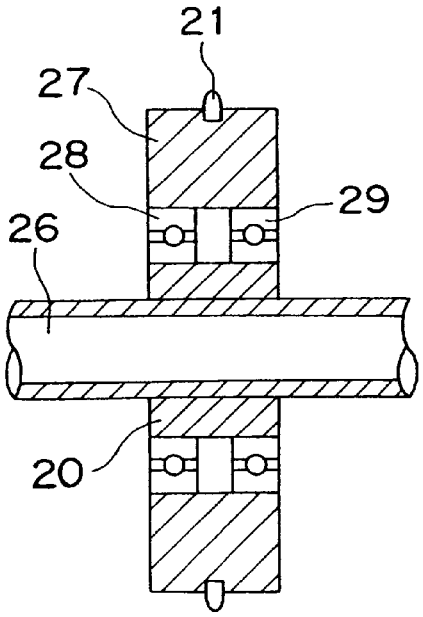

As shown in FIG. 6, the guide rollers 65, 66 receive sprocket holes at one side end of the sheet 1 so as to limit a widthwise shift of the sheet 1. Further, as shown in FIG. 7*a* and 7*b*, guide rollers 61, 62 are provided, being substantially flush with the belts 22*a* and 22*b* of the guide rollers 65, 66 so as to prevent the sheet 1 from being deformed.

Next, referring to FIGS. 1, 7*a* and 7*b*, the reduction of the shift value will be explained in detail. Since the tractors 3*a*, 3*b* are provided both upstream and downstream of the image recording parts 4*a* to 4*d*, as viewed in the sheet conveying direction, the distance therebetween becomes large. Meanwhile, since the rollers 65 and 66 serve as rollers for reversing the direction of the conveyance after toner is transferred onto the first surface of the sheet 1, the sheet 1 is limited widthwise thereof at these two positions, and the shift value is determined between the tractor 3*a* and the guide roller 65, and between the guide roller 66 and the tractor 3*b*. Thus, the shift value widthwise of the sheet 1 can be reduced. Further, although the guide rollers 65, 66 are driven by the sheet 1, the inertial masses thereof are low since only the belts 22 are driven, thereby it is possible to prevent occurrence of deformation of sprocket holes of the recording medium 1.

It is noted that each of the guide rollers 65 and 66 may have the following structure (FIG. 8): the pins 21 are embedded in a resin roller 27 at intervals equal to that of the sprocket holes of the sheet 1, and the roller 27 is attached to a carrier 20 through the intermediary of ball bearings 28, 29 so as to be rotatable while the carrier 20 is attached to the shaft 26 so as to be movable to an optional position in accordance with a width of the sheet 1. With this arrangement, the guide roller having a long use life can be obtained.

Figure 9:
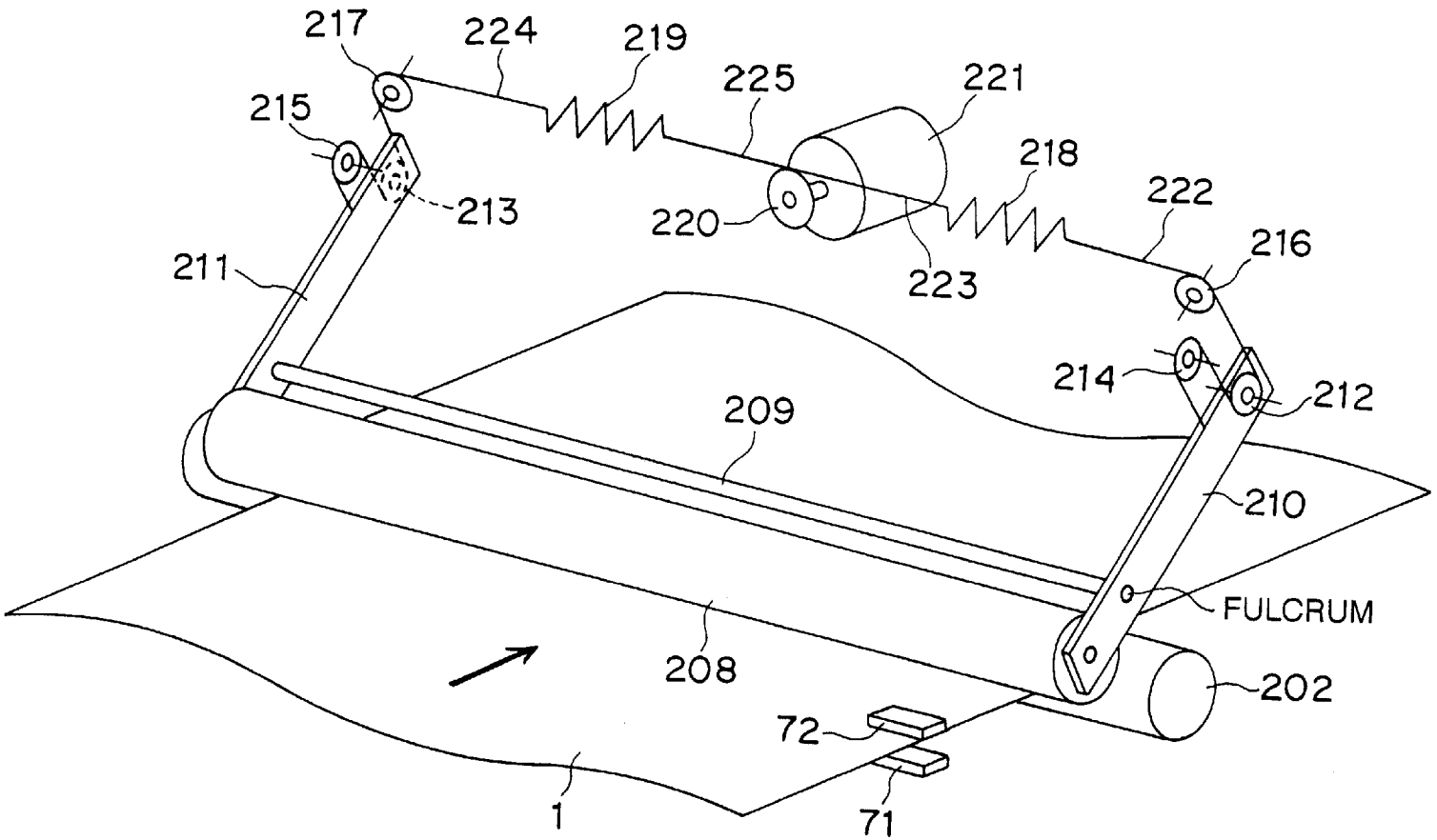
FIG. 9 is a perspective view illustrating other examples of a means for preventing speed variation in a sheet conveying direction.

FIG. 9 is a perspective view which shows a second embodiment of the speed variation preventing means in the sheet conveying direction.

In this embodiment, the speed variation preventing means 2 includes rollers 208, 202 which extend over the entire width of a sheet 1 so as to cause the pressing force to differ widthwise of the sheet in order to compensate the position widthwise of the sheet 1. Further, the sheet 1 is conveyed by the roller 202 on the lower side of the speed variation preventing means 2, serving as a drive roller, and a roller which is not shown, in the fixing part 5, instead of the tractors.

In the speed variation preventing means 2 in this embodiment, similar to the embodiment shown in FIG. 2, the sheet is partly wound on and clamped between the rollers 208, 202 so as to prevent the sheet from vibrating in the sheet conveying direction. If the sheet 1 is conveyed under no control with the use of the rollers extending over the entire width of the sheet, skewing inevitably occurs. Accordingly, in this embodiment, the pressing forces exerted to the left and right sides of the rollers 208, 202 are made to be different from each other so as to make the conveying forces applied widthwise of the sheet 1 different from each other in order to compensate the position widthwise of the sheet 1.

Specifically, when a positional shift of the sheet 1 occurs, irradiation to a line sensor 71 which is a CCD (charged coupled device) image sensor, from an LED 72 serving as a light source, is blocked by a side end of the sheet 1, and accordingly the positional shift is detected by the line sensor 7. Thus, a compensation control part which is not shown delivers a signal corresponding to a compensating value. In response to this signal, a control motor 221 is rotated by a predetermined angle so as to change the pulling forces of springs 218, 219. The difference between the pulling forces is transmitted to arms 210, 211 which are attached to a shaft 209 so that their fulcrum points are rotatable, through wire ropes 222, 223, 224, 225 which are attached, at their ends connected to springs 218, 219, to a pulley 220 of the control motor 221 while the directions of the forces are changed by pulleys 212, 213, 214, 215, 216, 217, and accordingly, a difference in pressure between the left and right rollers attached to the distal ends of the arms 210, 211 is effected. This difference in pressure causes the conveying forces applied widthwise of the sheet 1 to differ from each other, thereby it is possible to compensate the sheet 1 for a positional shift of the latter.

In such a case that box paper which is not shown and which is folded along perforations and stored in a corrugated box or the like is used as a sheet pay-out part, and in the case of such an apparatus that the sheet is delivered through the conveying operation of the tractors 3*a*, although vibration occurs due to friction between the box and the sheet, either of the speed variation preventing means 2 according to the present invention can prevent the sheet 1 from vibrating caused by the perforations when it is delivered from the box paper, similar to the rolled sheet 11.

Figure 10:
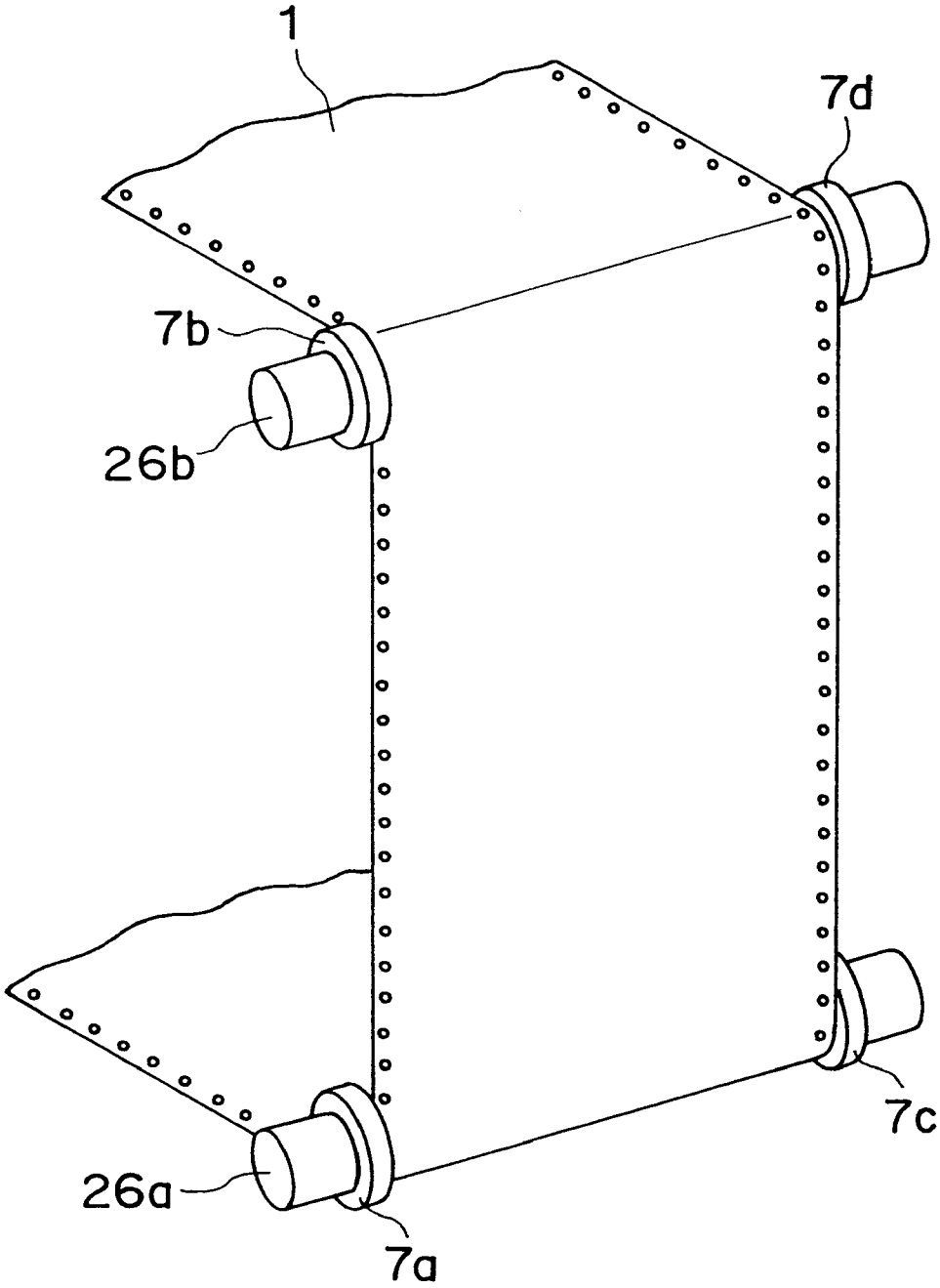
FIG. 10 is a perspective view illustrating another example of the shift reducing means.
Figure 11:
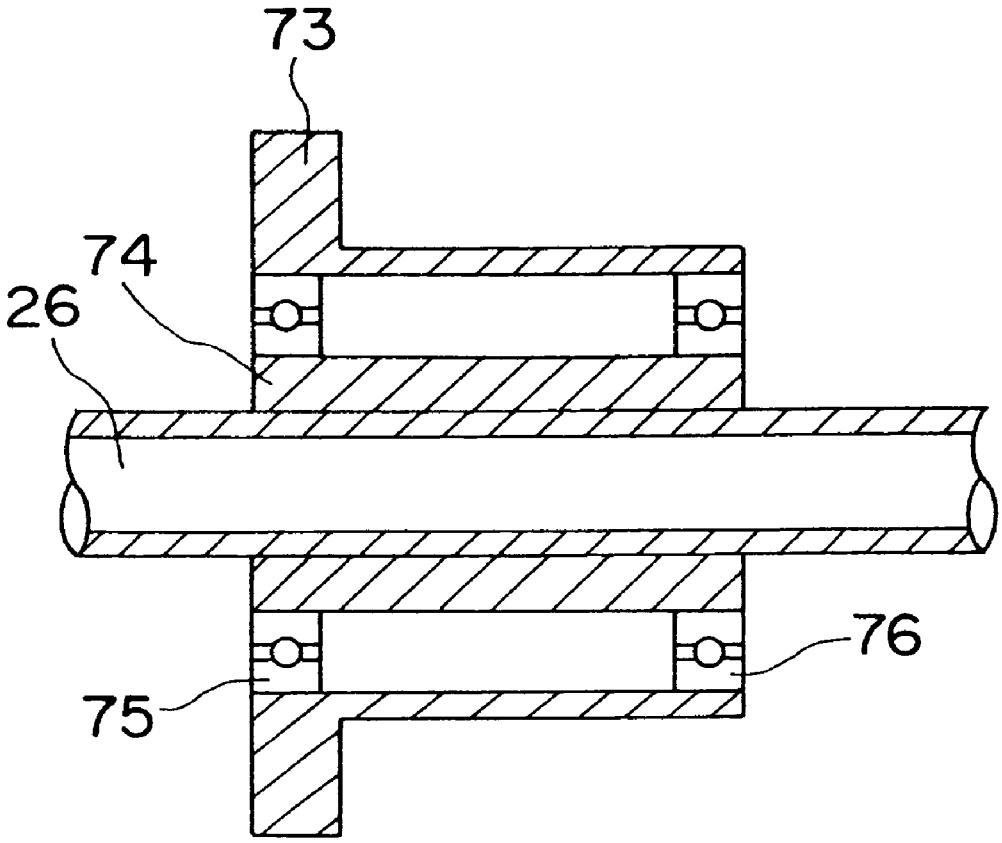
FIG. 11 is a view illustrating a structure of a guide roller in the shift reducing means shown in FIG. 10.
Figure 12:
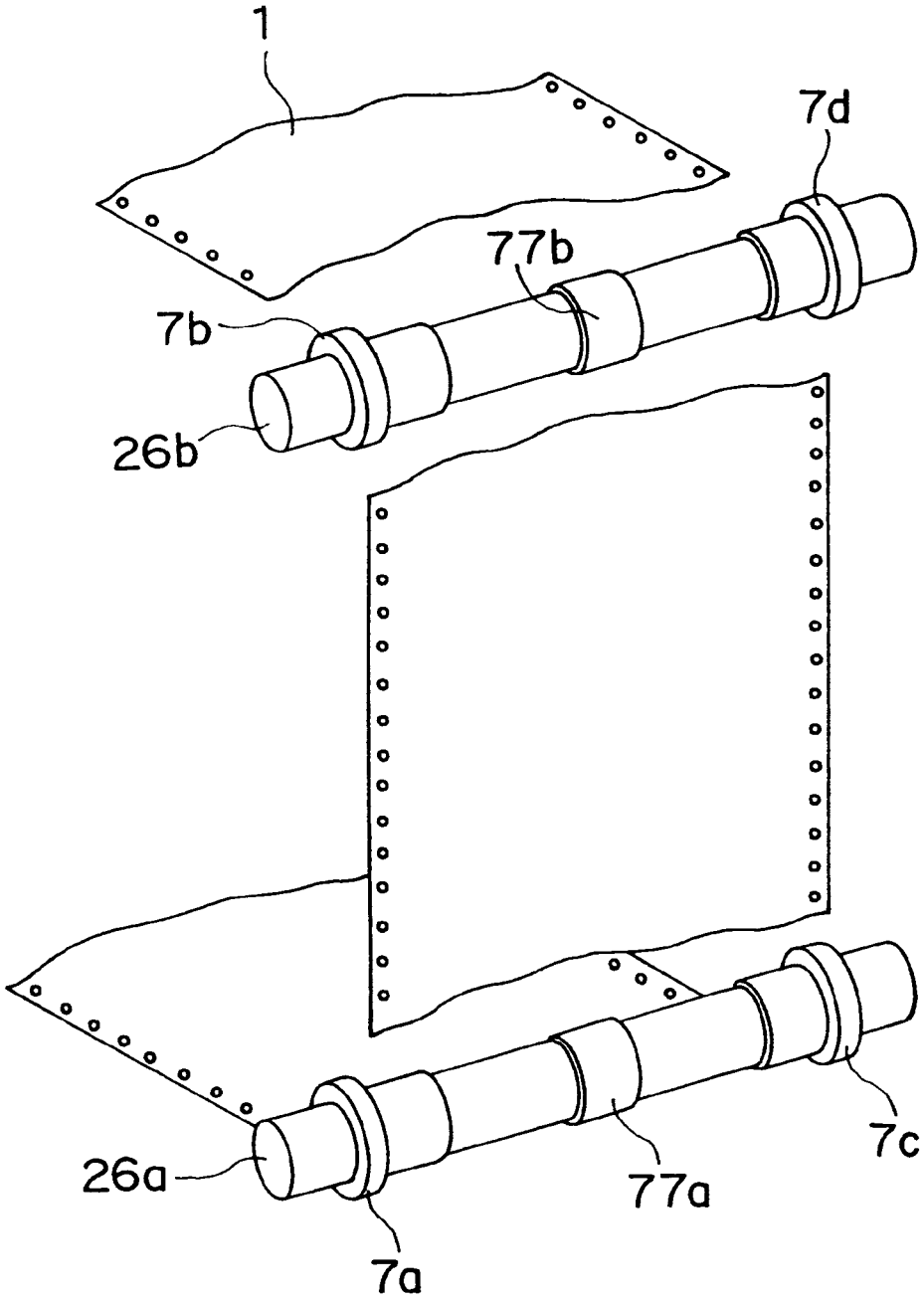
FIG. 12 is a perspective view illustrating the shift reducing means shown in FIG. 10, from which a part of the sheet is removed.

FIG. 10 to 12 show a second embodiment of a means for reducing a shift value during conveyance of a sheet. The means for reducing a shift value, which is shown in FIG. 10 in its entirety, includes guide rollers 7*a*, 7*b*, 7*c*, 7*d*. Each of these rollers 7*a*, 7*b*, 7*c*, 7*d* includes, as shown in FIG. 11, a paper guide part 73 formed with a surface perpendicular to the contact surface of the sheet 1, ball bearings 75, 76 for rotatably holding this paper guide part 73, and a carrier 74 for moving the paper guide part 73 through the intermediary of a shaft 26 so as to be adjusted to the width of the sheet 1.

Further, the opposite side end parts (edges) of the sheet 1 are clamped by the guide rollers 7*a* and 7*c*, 7*b* and 7*d* so as to limit the positions of the side end parts in order to reduce the shift value of the sheet 1. It is noted that the gaps between the guide rollers 7*a* to 7*d* and the side end parts of the sheet 1 are preferably set to be less than 0.5 mm, and desirably, less than 0.2 mm.

Further, as shown in FIG. 12, auxiliary rollers 77*a*, 77*b* substantially flush with the surface of the sheet 1 with which the guide rollers 7*a*, 7*b*, 7*c*, 7*d* make contact, are provided in the center parts of shafts 26*a*, 26*b*, for preventing the sheet 1 from being creased (deformed). Since the guide rollers 7*a* to 7*d* can be moved by the carriers 74, the sum of the widths of the guide rollers 77*a*, 77*b* and the widths of the contact surfaces of the guide rollers is set to be less than a minimum width of the sheet 1.

According to the present invention, the side end parts of the sheet 1 are regulated by the guide rollers so as to reduce the shift value, and therefore, even a sheet having no sprocket holes can be used.

As mentioned above, according to the present invention, means for preventing occurrence of speed variation is provided upstream of an image recording part so as to prevent vibration in the sheet conveying direction caused by the supply operation of a sheet 1, and further, the guide rollers having pins adapted to be engaged in sprocket holes of the sheet, or limiting the positions of the side end parts of the sheet are provided between the arrangement positions of the tractors as members for conveying a recording medium so as to reduce a shift value widthwise of the recording medium. Thereby it is possible to provide an image recording apparatus which can obtain a highly accurate and satisfactory image with no print shift and color drift in the image recording part.

Although an apparatus incorporating both the speed variation preventing means and the shift value reducing means has been explained in the above-mentioned embodiment, the speed variation preventing means can control the pressing force widthwise of the sheet so as to exhibit an effect of reduction of a shift value. Further, the provision of even only the shift value reducing means can also exhibit the effect.

What is claimed is:

1. An image recording apparatus, comprising:

a pay-out part for paying out a continuous recording medium, a plurality of image recording parts for forming a toner image and for transcribing the toner image onto the recording medium, a fixing part for fixing said toner image onto the recording medium, conveying means for driving and conveying the recording medium among at least the pay-out part, the plurality of image recording parts and the fixing part, speed variation preventing means including rollers for winding and clamping said recording medium thereon and therebetween for preventing a speed of the recording medium from varying, and means for reducing a shift value of said recording medium.

2. An image recording apparatus as set forth in claim 1, wherein said speed variation preventing means is provided upstream of any one of said plurality of image recording parts.

3. An image recording apparatus as set forth in claim 1, wherein said shift value reducing means is provided between said plurality of image recording parts.

4. An image recording apparatus as set forth in claim 1, wherein the inside of one of said rollers is a roller having a width substantially equal to the entire width of said recording medium.

5. An image recording apparatus, comprising:

a pay-out part for paying out a continuous recording medium, a plurality of image recording parts for forming a toner image and for transcribing the toner image onto said recording medium, a fixing part for fixing said toner image onto said recording medium.

conveying means for driving and conveying said recording medium among at least the pay-out part, the plurality of image recording parts and the fixing part, means for preventing a speed of said recording medium from varying; and means for reducing a shift value, wherein said speed variation preventing means includes rollers for winding and clamping said recording medium thereon and therebetween, and wherein the inside of one of said rollers is composed of a plurality of independent rollers which are spaced from one another, widthwise of said recording medium.

6. An image recording apparatus, comprising:

a pay-out part for paying out a continuous recording medium, a plurality of image recording parts for forming a toner image and for transcribing the toner image onto said recording medium, a fixing part for fixing said toner image onto said recording medium, conveying means for driving and conveying said recording medium among at least the pay-out part, the plurality of image recording parts and the fixing part, means for preventing a speed of said recording medium from varying; and means for reducing a shift value, wherein said shift value reducing means is a guide roller having pins.

7. An image recording apparatus, comprising:

a pay-out part for paying out a continuous recording medium, a plurality of image recording parts for forming a toner image and for transcribing the toner image onto said recording medium, a fixing part for fixing said toner image onto said recording medium, conveying means for driving and conveying said recording medium among at least the pay-out part, the plurality of image recording parts and the fixing part, means for preventing a speed of said recording medium from varying; and means for reducing a shift value, wherein said shift value reducing means is a guide roller for limiting a side end part of said recording medium.

8. An image recording apparatus, comprising:

a pay-out part for paying out a continuous recording medium;

a plurality of image recording parts for forming a toner image and transcribing the toner image onto said recording medium;

a fixing part for fixing said toner image;

conveying means for driving and conveying said recording medium among at least the pay-out part, the plurality of image recording parts and the fixing part; and speed variation preventing means including rollers for winding and clamping said recording medium thereon and therebetween, which controls a force widthwise of said recording medium.

9. An image recording apparatus as set forth in claim 8, wherein the inside of one of said rollers is a roller having a width substantially equal to the entire width of said recording medium.

10. An image recording apparatus, comprising:

a pay-out part for paying out a continuous recording medium;

a plurality of image recording parts for forming a toner image and transcribing the toner image onto said recording medium;

a fixing part for fixing said toner image;

conveying means for driving and conveying said recording medium among at least the pay-out part, the plurality of image recording parts and the fixing part; and speed variation preventing means which controls a force widthwise of said recording medium, wherein said speed variation preventing means includes rollers for winding and clamping said recording medium thereon and therebetween, and wherein the inside of one of said rollers includes a plurality of independent rollers which are spaced from one another widthwise of said recording medium.

11. An image recording apparatus, comprising:

a pay-out part for paying out a continuous recording medium;

a plurality of image recording parts for forming a toner image and transcribing said toner image onto said recording medium;

a fixing part for fixing said toner image;

conveying means for driving and conveying said recording medium among at least the pay-out part, the plurality of image recording parts and the fixing part; and a guide roller having pins for reducing a shift value of said recording medium.

12. An image recording apparatus as set forth in claim 11, wherein said guide roller is provided between said plurality of image recording parts.

13. An image recording apparatus, comprising:

a pay-out part for paying out a continuous recording medium;

a plurality of image recording parts for forming a toner image and transcribing said toner image onto said recording medium;

a fixing part for fixing said toner image;

conveying means for conveying said recording medium among the pay-out part, the plurality of image recording parts and the fixing part; and shift value reducing means for said recording medium;

wherein said shift value reducing means is a guide roller having pins.

14. An image recording apparatus, comprising:

a pay-out part for paying out a continuous recording medium;

a plurality of image recording parts for forming a toner image and for transcribing the toner image onto the recording medium;

a fixing part for fixing said toner image onto the recording medium;

conveying means for conveying the recording medium among the pay-out part, the plurality of image recording parts and the fixing part;

means for preventing a speed of the recording medium from varying; and means for reducing a shift value of said recording medium;

wherein said shift value reducing means is a guide roller for limiting a side end part of said recording medium.

15. An image recording apparatus, comprising:

a pay-out part for paying out a continuous recording medium;

a plurality of image recording parts for forming a toner image and for transcribing the toner image onto said recording medium;

a fixing part for fixing said toner image onto said recording medium;

conveying means for driving and conveying said recording medium among at least the pay-out part, the plurality of image recording parts and the fixing part; and a guide roller for limiting a side end part of said recording medium.

16. An image recording apparatus as set forth in claim 15, wherein said guide roller is provided between said plurality of image recording parts.

17. An image recording apparatus, comprising:

a pay-out part for paying out a continuous recording medium;

a plurality of image recording parts for forming a toner image and for transcribing the toner image onto said recording medium;

a fixing part for fixing said toner image onto said recording medium;

conveyers, connecting the pay-out part, the plurality of image recording parts and the fixing part with one another, for driving and conveying said recording medium among at least the pay-out part, the plurality of image recording parts and the fixing part;

driven rollers which wind and clamp said recording medium thereon and therebetween; and a limiting part for limiting a side end part of said recording medium.

18. An image recording apparatus as set forth in claim 17, wherein the inside of one of said driven rollers includes a plurality of independent rollers which are spaced apart from one another, widthwise of said recording medium.

19. An image recording apparatus as set forth in claim 17, wherein said driven rollers are provided upstream of any one of said plurality of image recording parts.

20. An image recording apparatus as set forth in claim 17, wherein said limiting part is provided between said plurality of image recording parts.

21. An image recording apparatus as set forth in claim 17, wherein said limiting part is a guide roller having pins.

22. An image recording apparatus as set forth in claim 17, wherein said limiting part is a guide roller for limiting a side end part of said recording medium.

23. An image recording apparatus as set forth in claim 17, wherein the inside of one of said driven rollers is a roller having a width substantially equal to the entire width of said recording medium.

24. An image recording apparatus, comprising:

a pay-out roller which pays out a continuous recording medium;

a plurality of image recorders which form a toner image on said recording medium;

a plurality of transcribers which transcribe the toner image onto said recording medium;

a fixing part which fixes said toner image onto said recording medium;

conveying rollers which drive and convey said recording medium among at least the pay-out roller, the plurality of image recorders, the plurality of transcribers and the fixing part;

rollers which wind and clamp said recording medium thereon and therebetween to prevent a speed of said recording medium from varying; and guide rollers which reduce a shift value of said recording medium in a widthwise direction.

25. An image recording apparatus, comprising:

a pay-out roller which pays out a continuous recording medium;

a plurality of image recording parts which form a toner image on said recording medium;

a plurality of transcribers which transcribe the toner image onto said recording medium;

a fixing part which fixes said toner image on said recording medium;

conveying rollers which drive and convey said recording medium among at least the pay-out roller, the plurality of image recording parts, the plurality of transcribers and the fixing part; and rollers which wind and clamp said recording medium thereon and therebetween, to control a force widthwise of said recording medium.

26. An image recording apparatus, comprising:

a pay-out roller which pays out a continuous recording medium;

a plurality of image recording parts for forming a toner image on said recording medium;

a plurality of transcribers which transcribe said toner image onto said recording medium;

a fixing part which fixes said toner image on said recording medium;

conveying rollers which drive and convey said recording medium among at least the pay-out roller, the plurality of image recording parts, the plurality of transcribers and the fixing part; and a guide roller having pins thereon which reduces a shift value of said recording medium.

* * * * *